US006056577A

United States Patent [19]

Blanchet

[11] Patent Number: 6,056,577

[45] Date of Patent: May 2, 2000

[54] ELECTRICAL CONNECTOR WITH INTERLOCK

[75] Inventor: Lucien Blanchet, Le Vesinet, France

[73] Assignee: Air-LB GmbH, Saarlouis, Germany

[21] Appl. No.: 09/080,219

[22] Filed: May 18, 1998

[30] Foreign Application Priority Data

May 29, 1997 [FR] France ..... 97 06618

[51] Int. Cl.[7] ..... H01R 13/627

[52] U.S. Cl. ..... 439/352

[58] Field of Search ..... 439/352, 321, 439/320, 350

[56] References Cited

U.S. PATENT DOCUMENTS

| | | | |
|---|---|---|---|
| 3,694,793 | 9/1972 | Concelman . | |
| 4,902,045 | 2/1990 | McGugan et al. . | |
| 5,496,189 | 3/1996 | Over et al. | 439/321 |
| 5,630,570 | 5/1997 | Lacroix et al. . | |
| 5,785,545 | 7/1998 | Holt | 439/352 |

FOREIGN PATENT DOCUMENTS 2 618 871 2/1989 France .

*Primary Examiner*—Lincoln Donovan
*Assistant Examiner*—Eugene G. Byrd
*Attorney, Agent, or Firm*—Young & Thompson

[57] ABSTRACT

Electrical connector with interlock, including a first part carrying at least one contact and a second part carrying at least one contact, each part having a housing in which the corresponding contact is held. An axially movable locking ring is mounted on the housing of the second part for locking the second part on the first part. The connector includes a retainer that retains the locking ring in the retracted position on the housing of the second connector part, a member for blocking the locking ring in the retracted position at the commencement of the fitting together of the housings of the two parts, a member for eliminating the effect of retaining the locking ring, a member for snap-fastening the two housings one on the other and unblocking the locking ring at the end of the fitting together of the two housings, and a member for locking the two housings in a snap-fastened position as a result of the axial advance of the locking ring.

13 Claims, 9 Drawing Sheets

ELECTRICAL CONNECTOR WITH INTERLOCK

BACKGROUND OF THE INVENTION

The present invention relates to an electrical connector with interlock, comprising a first part carrying at least one contact, for example a female contact, and a second part carrying at least one contact, for example a male contact.

On connectors of this type, each connector part generally comprises a housing, in which the corresponding contact is held by an insulator, the housing of the second part being capable of fitting onto the housing of the first part. The housing of the second connector part may carry a movable ring for locking the second part on the first part, for the purpose of fitting together the housings of the two connector parts.

Known connectors of this type, commonly called connectors of the push-pull type, generally have a relatively complicated structure, being composed of many often complicated production and assembly parts. These connectors are consequently of high cost, and their reliability leaves much to be desired. Moreover, the inactive and active positions of the locking ring are often not defined in a stable and accurate manner.

SUMMARY OF THE INVENTION

The present invention is aimed at a connector of the above-defined type which, whilst having high reliability, is of simple structure and reduced cost, being composed of a small number of parts which are simple to produce, in particular by moulding from plastic, without the need for re-machining, the various positions of the locking ring being clearly defined.

The electrical connector with interlock according to the invention comprises a first part carrying at least one contact and a second part carrying at least one contact. Each part comprises a housing, in which the corresponding contact is held by an insulator, the housing of the second part being capable of fitting onto the housing of the first part and carrying a movable ring for locking the second part on the first part, at the end of the fitting together of the housings of the two parts. The connector comprises means for retaining the locking ring in the inactive retracted position on the housing of the second connector part, as long as the housings of the two connector parts are not fitted together. It comprises, furthermore, means for blocking the locking ring in the inactive retracted position at the commencement of the fitting together of the housings of the two parts. It comprises, moreover, means for eliminating the effect of retaining the locking ring during the fitting together. It comprises, in addition, means for snap-fastening the two housings one on the other and for unblocking the locking ring at the end of the fitting together of the two housings. It also comprises means for locking the two housings in the snap-fastened position by displacing the locking ring into the active advanced position on the housing of the second connector part.

Preferably, the connector comprises, moreover, means for holding the locking ring in the active position locking the two housings in the snap-fastened position.

On the connector according to the invention, all the abovementioned means are carefully arranged directly on the two housings and on the locking ring as well as, if appropriate, on a single additional part, all these parts being capable of being moulded from plastic, without the need for re-machining.

Preferably, the means for retaining the locking ring in the inactive retracted position comprise at least one inner tab formed so as to protrude on the locking ring, in such a way as to co-operate by elasticity with an outer groove of the housing of the second connector part.

According to a first embodiment, the means for eliminating the retaining effect comprise at least one member integral with the housing of the first connector part, outside the said housing, for pushing the said tab of the locking ring outwards in order to release it from the said groove.

According to a second embodiment, the means for eliminating the retaining effect comprise at least one stud movable radially in the housing of the second connector part, in line with the said groove, between an inner position, in which the stud is brought by elasticity and projects inwards beyond the said housing, and an outer position, in which the stud is brought by the housing of the first connector part during the fitting together of the two housings, in order to push the said tab of the locking ring outwards and release it from the outer groove of the housing of the second connector part.

According to the two embodiments, the blocking and snap-fastening means may advantageously comprise at least one stud movable radially in the housing of the second connector part between an inner position, in which the stud is brought by elasticity and projects inwards beyond the said housing, and an outer position, in which the stud is brought by the housing of the first connector part during the fitting together of the two housings, in which position it projects radially outwards beyond the housing of the second connector part. These means comprise, furthermore, an inner groove in the locking ring for receiving the said stud when the latter is pushed outwards by the housing of the first connector part at the commencement of the fitting together of the two housings. These means comprise, moreover, an outer groove in the housing of the first connector part, receiving the said stud by elastic snap-fastening at the end of the fitting together of the housings of the two connector parts.

According to the first embodiment, this blocking and snap-fastening stud is formed at the end of an elastic lug formed so as to protrude on the housing of the second connector part.

According to the second embodiment, the stud for eliminating the retaining effect and the blocking and snap-fastening stud are both formed on an elastic collar attached in an outer groove of the housing of the second connector part.

BRIEF DESCRIPTION OF THE DRAWINGS

Referring to the accompanying diagrammatic drawings, two embodiments of a connector according to the invention will be described in more detail below; in the drawings:

FIGS. 2*a* to 6*a* are axial sections through the connector of FIG. 1, showing the coupling kinematics of this connector, and FIGS. 2*b* to 6*b* show partial axial sections taken in a plane slightly offset angularly, illustrating another detail, in the same positions of the connector parts as in FIGS. 2*a* to 6*a;*

DESCRIPTION OF THE PREFERRED EMBODIMENTS

Figure 1:
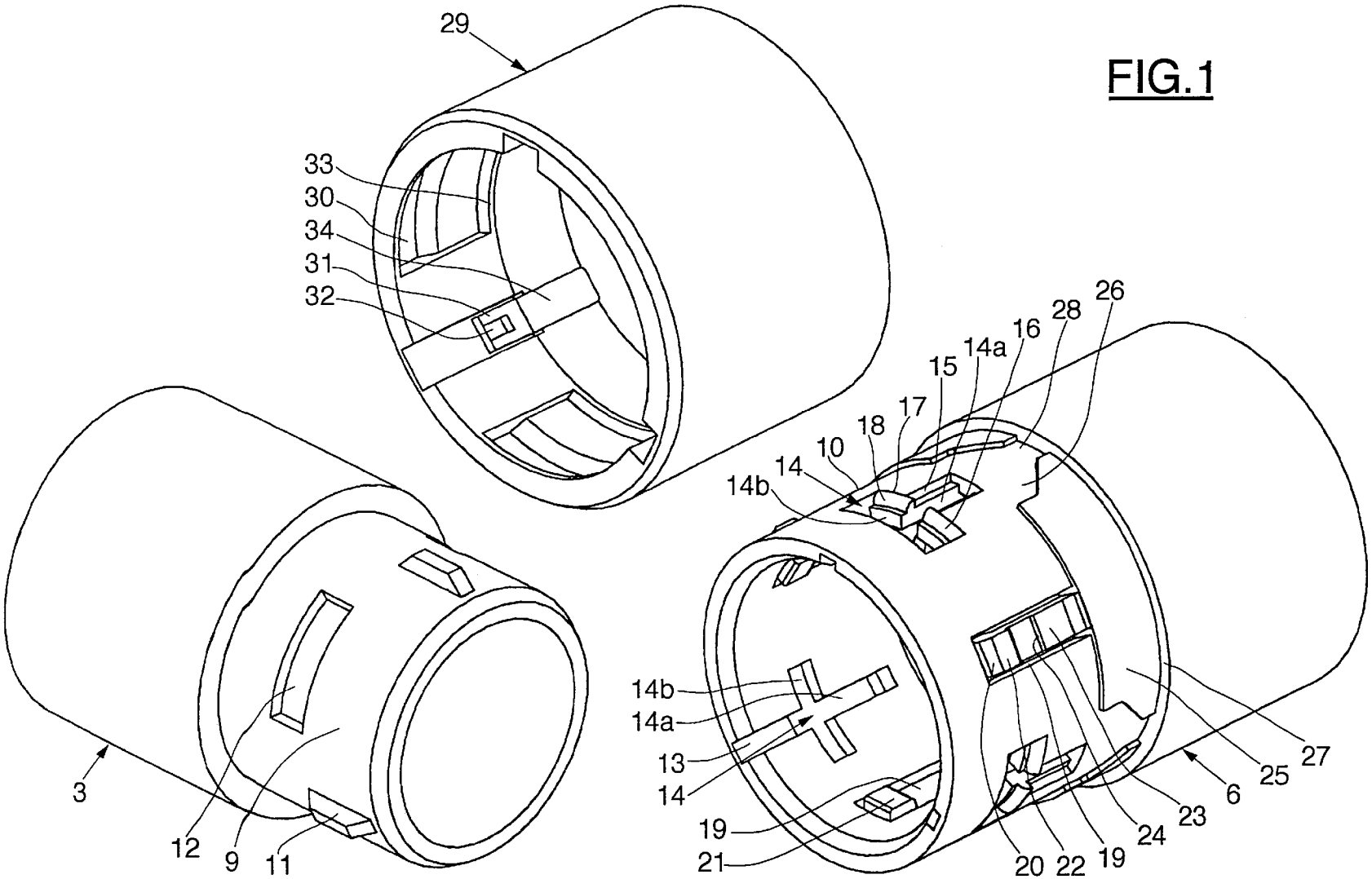
FIG. 1 is a perspective view of the two housings and the locking ring of a connector according to a first embodiment of the invention.

The connector, as illustrated in FIGS. 1 to 6, comprises, as shown, above all, in FIGS. 2*a* to 6*a*, a first connector part 1, or fixed part, and a second connector part 2, or movable part, the two parts 1 and 2 being intended to be coupled.

The first connector part 1 comprises a housing 3 of essentially cylindrical shape, in which (at least) one female contact 4 is held by means of an insulator 5 shown as being formed from two parts. In as much as the execution of the contact 4 and insulator 5 does not come within the scope of the present invention, these elements are illustrated highly diagrammatically in FIGS. 2 to 6 and are not illustrated at all in FIG. 1.

Correspondingly, the second connector part 2 comprises a housing 6 of essentially cylindrical shape, in which (at least) one male contact 7 is held by means of an insulator 8 shown diagrammatically as being formed from two parts.

The housings 3 and 6 of the two connector parts 1 and 2 comprise front fitting sections 9, 10 respectively, of general cylindrical shape, the fitting section 9 of the housing 3 being intended to fit into the fitting section 10 of the housing 6 during the coupling of the connector.

The fitting section 9 of the housing 3 carries externally three axial polarizing keys 11 offset by 120° relative to one another, each key 11 having a front flank and a rear flank which are oblique, in such a way that the key 11 has as a whole a trapezoidal shape. Moreover, three groove segments 12 are provided in the outer surface of the fitting section 9, each groove segment 12 being located angularly between two keys 11.

The fitting section 10 of the housing 6 has internally three axial slots 13 distributed angularly at 120° to one another, these slots 13 being intended for receiving the keys 11 of the section 9 of the housing 3 for polarizing purposes. Each slot 13, which starts at the front end of the fitting section 10, opens into a T-shaped recess 14 which passes through the wall of the section 10 in such a way that the slot 13 is in alignment with the axial bar 14*a* of the T. As emerges, above all, from FIG. 1, the axial bar 14*a* of the recess 14 is widened, before opening onto the outer surface of the section 10, in order thereby to form, on each side, a step 15 which is delimted in the direction of the front end of the section 10, at the location of the transverse bar 14*b* of the T-shaped recess 14, by a rim 16. As shown in FIG. 1, the rim 16 has a plane rear flank 17 perpendicular to the axis of the section 10 and a rounded front flank 18.

The fitting section 10 comprises, moreover, in intermediate angular positions each time between two recesses 14, a lug 19 extending so to protrude, in the thickness of the section 10, in the direction of the front end of the latter, so as to be capable of bending elastically radially inwards and outwards. At its free end, the lug 19 comprises a head 20, the radial dimension of which is greater than the (radial) thickness of the section 10. The head 20 thus forms an inner stud 21 which projects inwards on the inner surface of the section 10 and an outer stud 22 which projects from the outer surface of the section 10. On its outer surface, the lug 19 comprises a ramp 23 which terminates in a shoulder 24 on the side facing the head 20.

Finally, as emerges from FIG. 1, the fitting section 10 of the housing 6 is equipped externally, in its rear zone, with an annular part 25 of increased outside diameter, which is interrupted, at three locations offset by 120° relative to one another, by parts 26 which are each located at the rear of one of the recesses 14 and which extend over a circumferencial width decreasing from the rear end of the axial bar 14*a* of the T-shaped recess 14 towards the rear of the housing 6, in order to terminate, at the location of the shoulder 27 forming the rear end of the section 10, in an isthmus 28, the circumferencial width of which corresponds to the circumferencial width of the axial bar 14*a* of the recess 14 at the point level with the steps 15.

The fitting section 10 of the housing 6 of the connector part 2 receives externally a locking ring 29 which has internally three groove segments 30 distributed at 120° to one another and three tabs 31 extending so as to protrude in the direction of the front end of the ring 29, the said tabs being inclined towards the inside of the ring. Each tab 31 has a circumferencial width slightly smaller than the circumferencial width of the axial bar 14*a* of the recess 14 at the point level with the steps 15 (and therefore slightly smaller than the circumferencial width of the isthmus 28) and comprises, in the middle of its width, an inner boss 32 which emerges particularly from FIGS. 2*b* to 6*b*. At its rear edge, each groove segment 30 comprises an inner bead segment 33.

Figure 2A:
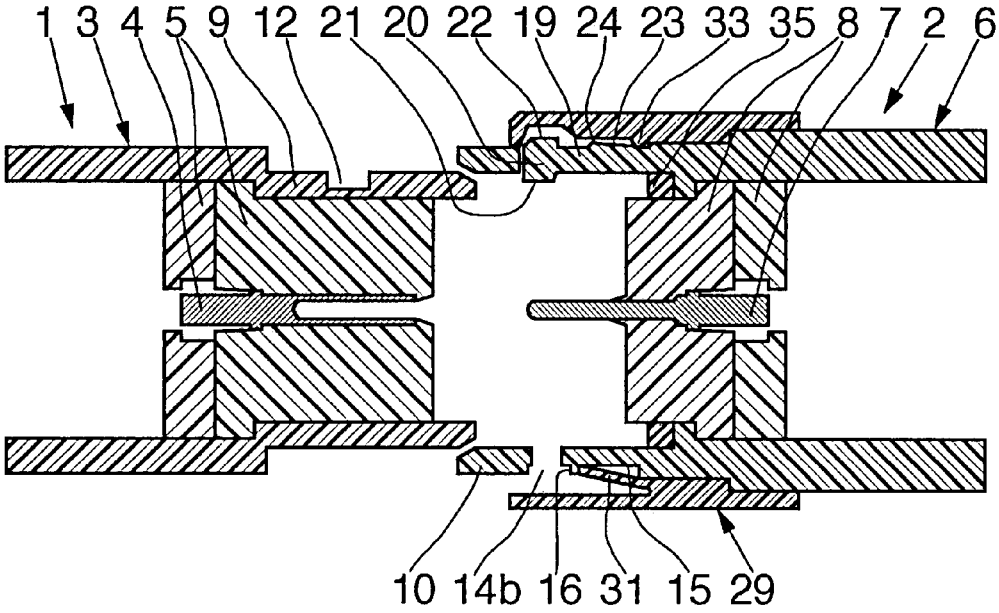
Figure 2B:
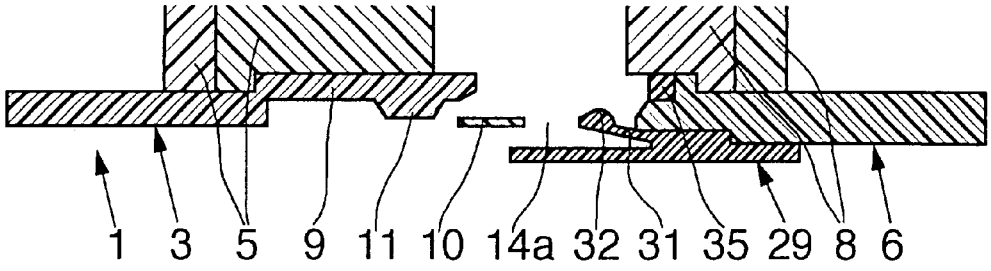
Figure 3A:
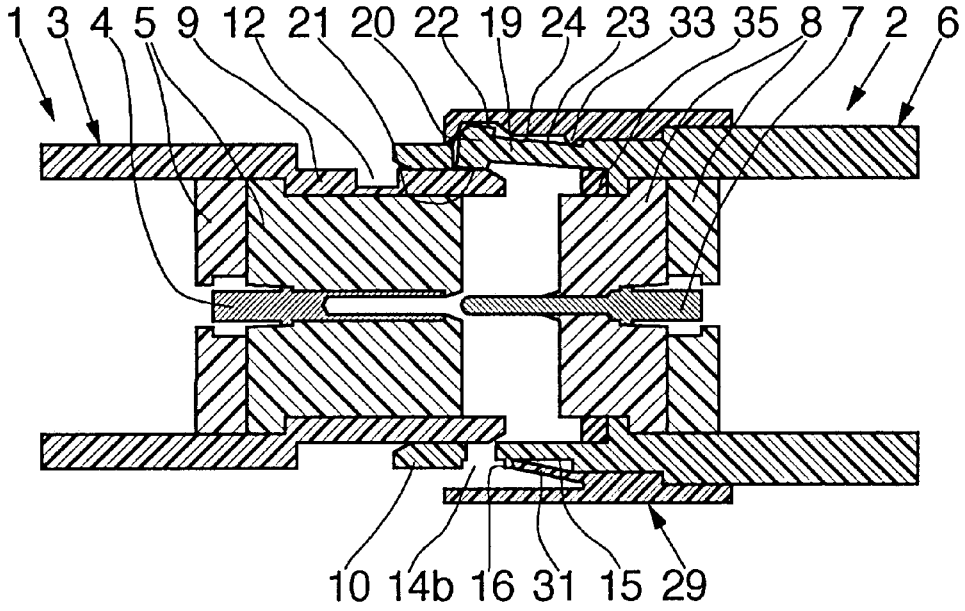
Figure 3B:
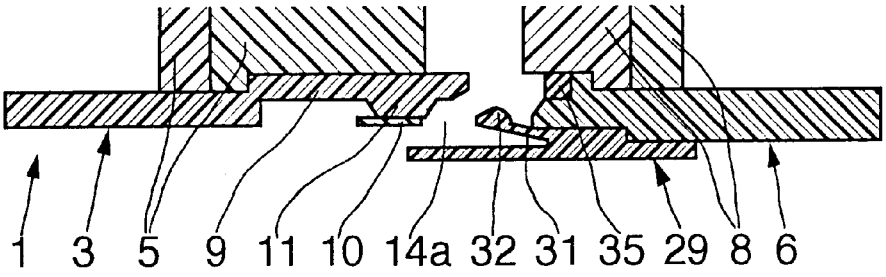

For the coupling kinematics of the connector, as described above, reference will be made to FIGS. 2*a* through 6*b*, which are axial sections in a plane passing level with one of the steps 15 and through one of the rims 16 of the housing 6, hence on one side of the axial bar 14*a* of the recess 14 and of a key 11 and on one side of the middle boss 32 of a tab 31 of the locking ring 29, whilst FIGS. 2*b* to 6*b* are corresponding partial sections in a plane passing through the middle of the axial bar 14*a* of a recess 14 of the housing 6, hence through the middle boss 32 of a tab 31 of the locking ring 29 and through one of the keys 11 of the housing 3.

The locking ring 29 is mounted on the fitting section 10 of the housing 6, in such a way that an axial web 34 projecting towards the inside of the ring 29 at the rear of a tab 31 comes into place in an isthmus 28 and that the corresponding tab 31 snaps into the steps 15 behind the rim 16 of the corresponding recess 14. This emerges clearly from FIG. 2*a*.

In order to couple the connector part 1 to the connector part 2, the locking ring 29 of which is, in this position, snap-fastened in, the section 9 of the connector part 1 is fitted into the section 10 of the connector part 2, the keys 11 ensuring polarization in combination with the slots 13. As soon as the front end of the section 9 reaches the heads 20 of the lugs 19, the latter bend outwards, their outer studs 22 penetrating into the groove segments 30 of the ring 29 (see FIGS. 3*a* and 3*b*). This causes the locking ring 29 to be blocked on the section 10 of the housing 6.

Figure 4A:
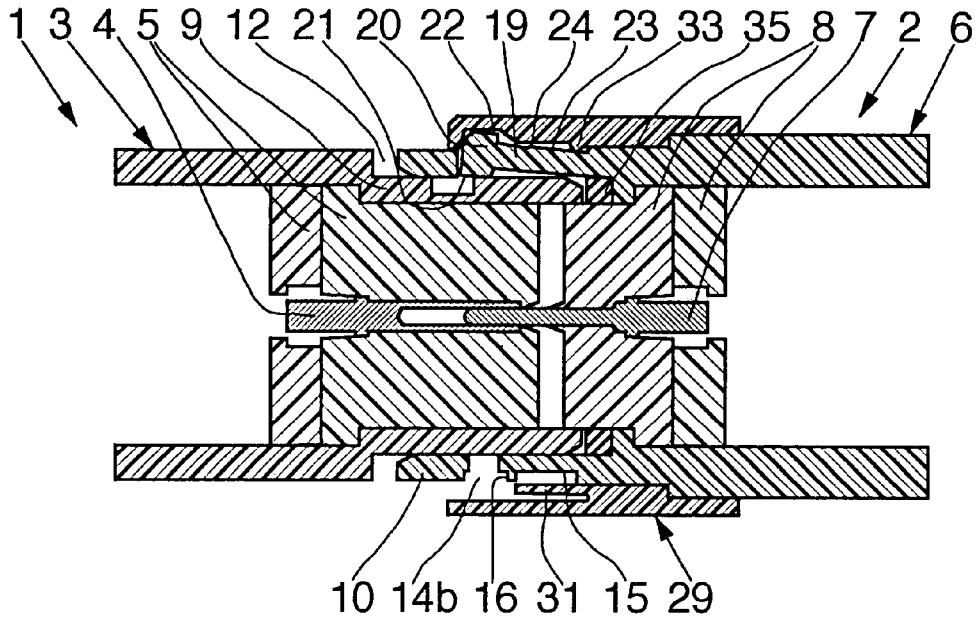
Figure 4B:
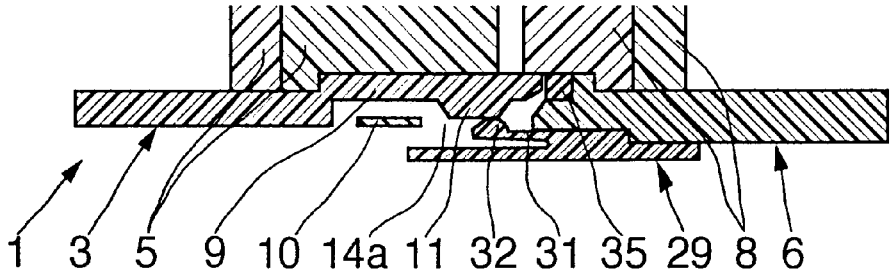

When the fitting movement is continued, each key 11, reaching the boss 32 of a tab 31, pushes the latter outwards (FIG. 4*b*), thus eliminating the retaining effect of the ring 9 by the tabs 31 and the rims 16 (see FIG. 4*a*).

Figure 5A:
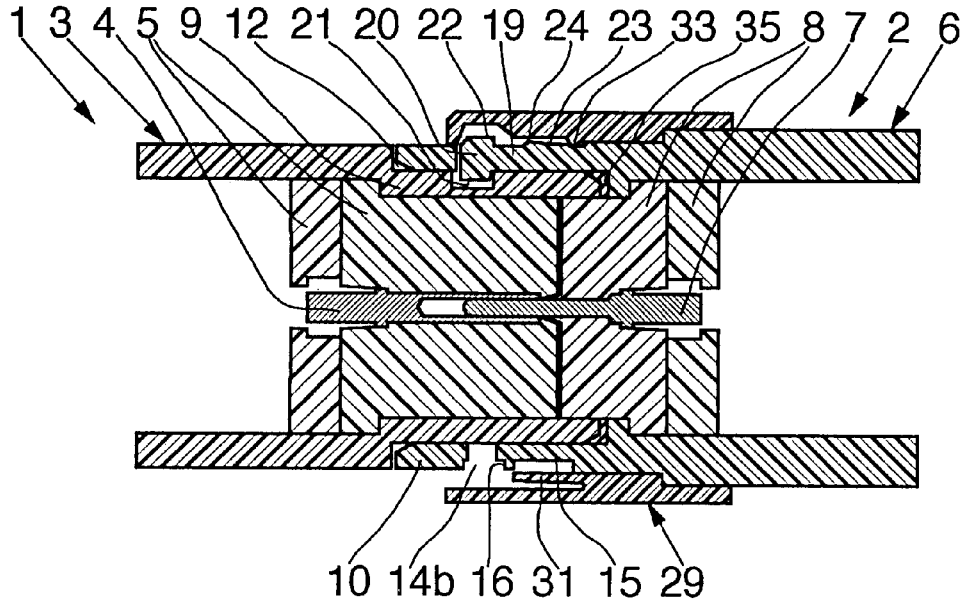
Figure 5B:
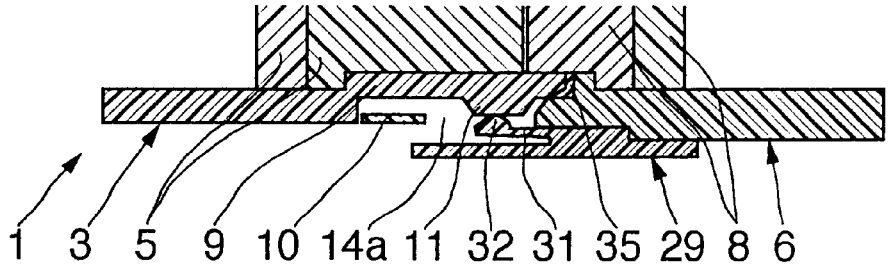
Figure 6A:
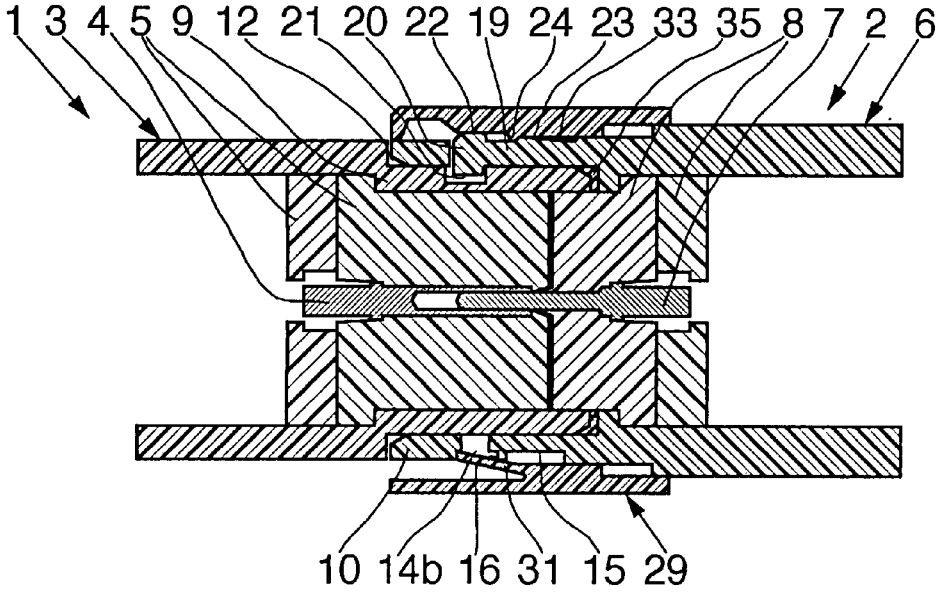
Figure 6B:
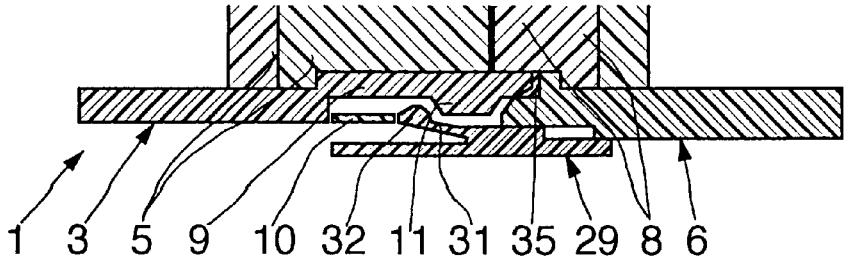

When the sections 9 and 10 of the two housings 3 and 6 are fitted one into the other as far as they will go, the inner studs 21 of the lugs 19 are in line with the groove segments 12 and expand elastically into the latter, thus causing the section 10 to be snap-fastened onto the section 9. In this position, as shown in FIG. 5*b*, the tabs 31 of the locking ring 29 still remain pushed outwards under the action of the keys 11.

In order to lock the connector in this fitting position, the locking ring 29 is pushed (to the left in FIGS. 5*a* and 5*b*) in the direction of the connector part 1, so that the bead segments 33 of the ring 29 climb on the ramps 23 of the lugs 19 until they engage behind the shoulders 24. At the same time, the bosses 32 of the tabs 31 of the ring 29 pass over the keys 11, thus allowing the tabs 31 to expand elastically inwards, the bosses 32 coming into place behind the keys 11 (see FIGS. 6*a* and 6*b*). The locking ring 29 is thus held in this axial position and locks the fitting sections 9 and 10 of the two housings 3 and 6 of the connector parts 1 and 2 in the snap-fastened position, that is to say the coupling position.

The connector, as illustrated in FIGS. 7 to 11, differs from the connector according to FIGS. 1 to 6 mainly in a separation of the various functions, so that each component part may be designed optimally to perform the functions assigned to it. In this particular case, these are, above all, the functions of blocking the locking ring and of snap-fastening together the two housings, the said functions being performed by members which form part not of the housing of one of the connector parts, but of an additional element attached to this housing.

The first connector part or female part 101 and the second connector part or male part 102 have one a housing 103, in which at least one female contact 104 is mounted by means of an insulator 105, and the other a housing 106, in which at least one male contact 107 is mounted by means of an insulator 108. The housing 103 of the connector part 101 comprises a front fitting section 109 and the housing 106 of the connector part 102 comprises a front fitting section 110 intended to fit onto the section 109.

Figure 7:
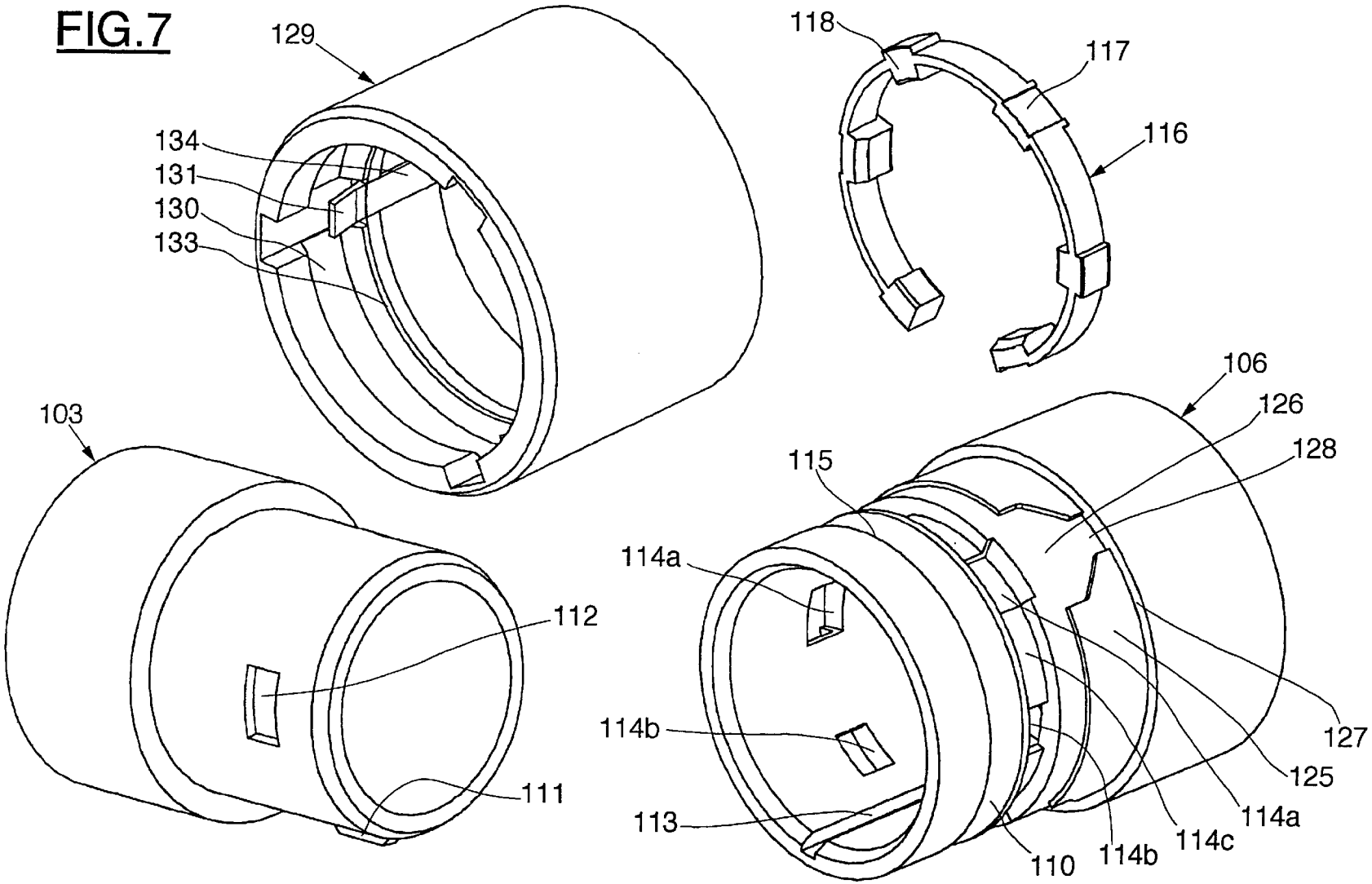
FIG. 7 is perspective view of the two housings, the locking ring and a studded collar of a second embodiment of a connector according to the invention.

According to FIG. 7, the fitting section 109 of the housing 103 has a single axial polarizing key 111 and three groove segments 112 offset by 120° relative to one another.

The fitting section 110 of the housing 106 has internally an axial slot 113 co-operating with the key 111 for the purpose of polarization. Six quadrangular passage holes 114*a*, 114*b* distributed at 60° relative to one another pass radially through the fitting section 110 which has, in the plane of the said passage holes, an outer circular groove 114*c*. At the rear of this groove, there is once again, on the fitting section 110, an annular part 125 of increased outside diameter, which is interrupted at three locations offset by 120°, behind each hole 114*a*, by a part 126 which decreases in circumferencial width rearwards and which terminates, level with an end shoulder 127, in an isthmus 128.

Moreover, an outer groove 115 is provided in the fitting section 110, between the groove 114*c* and the front end of this section 110.

A collar 116, that is to say a split hoop, comprising twice three studs 117 and 118 offset at 60° to one another, is attached in the groove 114*c*. The studs 117, which alternate with the studs 118, project inwards on the collar 116, whilst the studs 118 project both inwards and outwards on the collar 116.

The locking ring 129 comprises internally a groove 130, three tabs 131 offset at 120° relative to one another and extending so as to protrude in the direction of the front end, at the same time being inclined inwards, a bead 133 delimiting the groove 130 rearwards, and a web 134 projecting inwards at the rear of each tab 131.

The collar 116 is mounted in the groove 114*c*, in such a way that a stud 117 projecting only inwards on the collar 116 is in each hole 114*a* located in front of an interruption zone 126 of the part 125 and that a stud 118 is in each hole 114*b*. The locking ring 129 is subsequently mounted on the fitting section 110 of the housing 106 already equipped with the collar 116, in such a way that a tab 131 comes into place level with a stud 117 and snaps in when the locking ring 129 is in the fully retracted position, the webs 134 being located in the isthmuses 128, behind the front flank of the groove 114*c*, above a stud 117.

Figure 8:
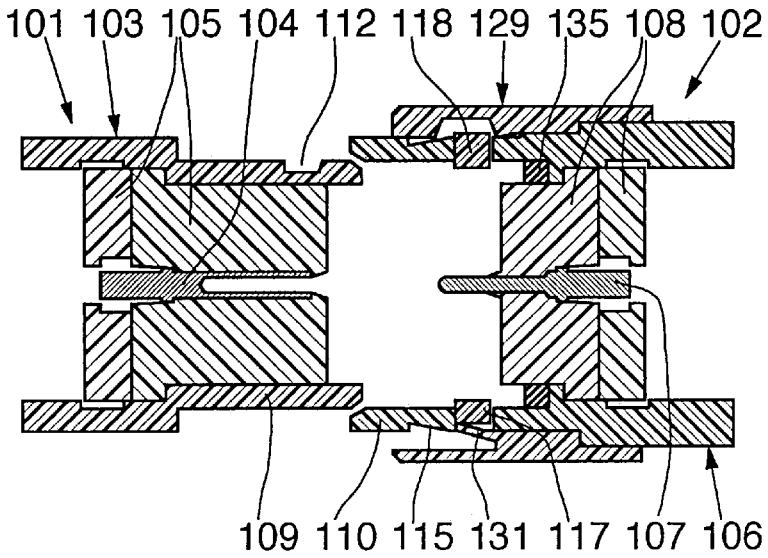
FIGS. 8 to 11 are axial sections through the connector of FIG. 7, showing the coupling kinematics of this connector.

As shown in FIG. 8, this ensures that the locking ring 129 is retained in the inactive retracted position on the housing 106. Since the collar 116 is mounted under pre-stress in the groove 114*c*, it is constricted by elasticity and drives the studs 117, 118 as far as they will go into the holes 114*a*, 114*b*.

Figure 9:
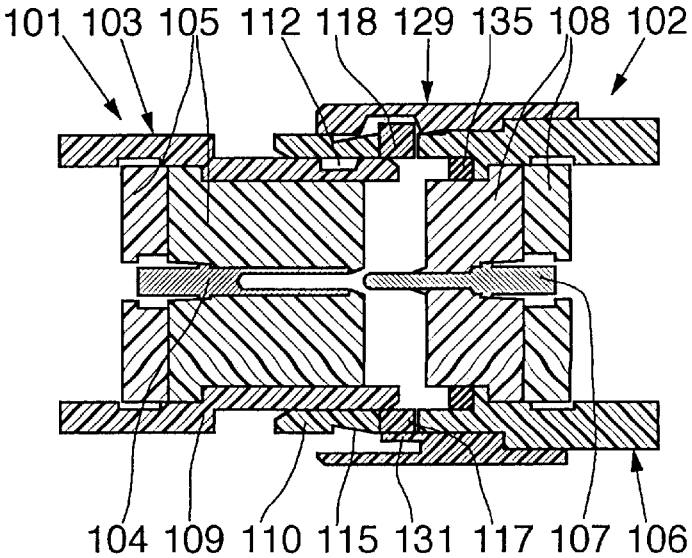

When the two sections 109, 110 of the housings 103 and 106 are being fitted together, the front end of the section 109, when reaching the studs 117 and 118, pushes these outwards, the result of this being, as shown in FIG. 9, that the studs 117 cause the tabs 131 of the ring 129 to bend outwards, thus releasing them from the groove 114*c*. Simultaneously, the studs 118 are pushed outwards into the groove 130 of the ring 129 and thereby block the ring 129 on the housing 106.

Figure 10:
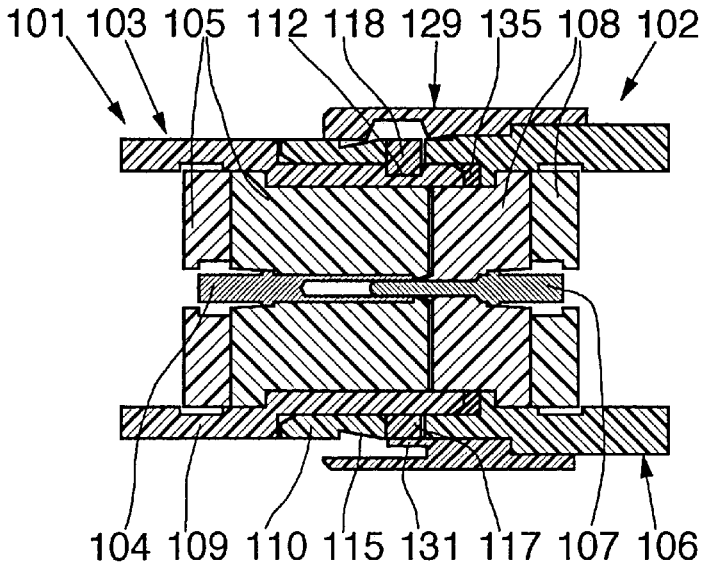
Figure 11:
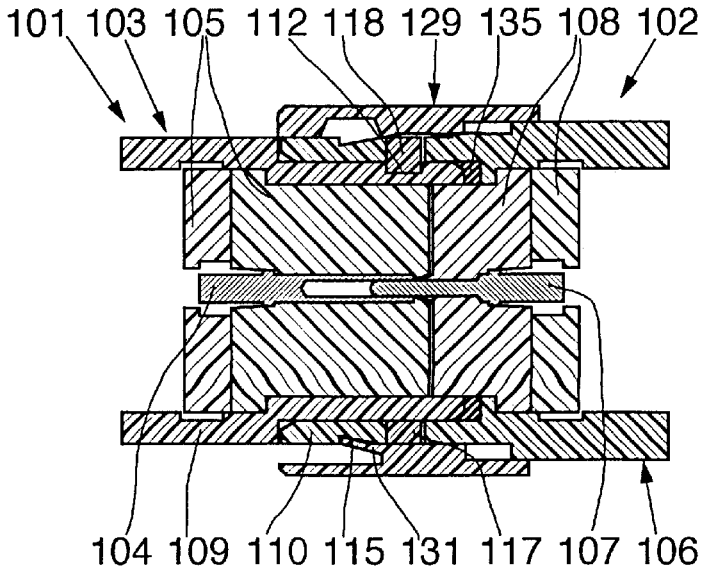

When the fitting movement is continued, the studs 118 finally reach the groove segments 112 of the fitting section 109 of the housing 103 and engage elastically inwards into these segments 112, with the effect of snap-fastening the two sections 109 and 110 one on the other, as shown in FIG. 10. At the same time, the blocking of the locking ring 129 in the rear position on the housing 106 is eliminated.

It is then possible to push the locking ring 129 in the direction of the housing 103 (to the left in the drawing), as a result of which, the studs 118 are kept driven into the groove segments 112 by the ring 129 and the tabs 131 engage elastically into the groove 115 of the section 110 of the housing 106. The ring 129 is thus held in the position locking the two housings 103, 106 relative to one another and can be retracted only by intentional rearward action (to the right in the drawing).

In the two embodiments shown and described, all the parts of the connector which are relevant to the present invention (the housings of the two connector parts, the locking ring and, where appropriate, the attached collar) may be produced by moulding from plastic, without the need for any re-machining.

If the connector is to be a metal-clad connector, it is possible to metallize the plastic component parts, without thereby in any way affecting their primary function.

In the advanced (locking) position of the locking ring 29, 129, it is possible to rotate the latter, for example over about ten degrees, thus making it possible to ensure that locking has taken place correctly. Such rotation is possible only in an advanced position due to the circumferencial width of the interruption zones 26, 126 of the part 25, 125 of the housings 6, 106, whilst the said rotation is prevented, in the retracted position of the ring, owing to the webs 34, 134 which are then immobilized angularly in the isthmuses 28, 128 of the interruption zones 26, 126.

In the two embodiments shown and described, a seal 35, 135, arranged inside the fitting section 10, 110 of the housing 6, 106 of the second connector part 2, 102 and compressed by the front end of the fitting section 9, 109 of the housing 3, 103 of the first connector part 1, 101, ensures, at the end of the fitting together of the two connector parts (locking), both leaktightness of the connector and, by virtue of its elastic return effect, compensation of play and the absence of any possibility of vibrations.

Finally, of the two connector parts 1 and 2, instead of the first comprising at least one female contact and the second at least one male contact, the first could likewise comprise at least one male contact and the second at least one female contact or both could comprise contacts of the two types. In all cases, the locking ring is mounted on the housing of a connector part which is movable, the other part being capable of being fixed.

We claim:

1. Electrical connector comprising:

a first connector part carrying at least one contact and a second connector part carrying at least one contact, each said connector part comprising a housing in which the corresponding said contact is held by an insulator, the housing of the second connector part being capable of fitting onto the housing of the first connector part upon coupling of said connector parts for interconnecting said contacts;

a locking ring mounted on the housing of the second connector part so as to be axially movable on said housing of the second connector between an inactive retracted position and an active advanced position;

retaining means for retaining said locking ring in said inactive retracted position so long as said housings are not interfitted;

blocking means for blocking said locking ring in said inactive retracted position at the beginning of an interfitting movement of the housings of said two connector parts;

releasing means for eliminating the action of said retaining means after blocking of the locking ring by said blocking means during interfitting of said housing;

snap-fastening and unblocking means for snap-fastening the two housings on one another and for unblocking the locking ring from the housing of said second connector part at the end of the interfitting movement of said two housings; and locking means for locking the two housings in the snap-fastened position upon shifting the locking ring into said active advanced position on the housing of said second connector part.

2. Connector according to claim 1, further comprising holding means for holding said locking ring in said active advanced position on the housing of said second connector part.

3. Connector according to claim 2, further comprising locking ensuring means preventing angular movability of said locking ring with respect to the housing of said second connector part except in said active advanced position of said locking ring.

4. Connector according to claim 1, wherein said retaining, blocking, releasing, snap-fastening and unblocking, and locking means are each integrally moulded with said housings and said locking ring from plastics material without any re-machining.

5. Connector according to claim 2, wherein said retaining, blocking, releasing, snap-fastening and unblocking, and locking means are integrally moulded with said housings and said locking ring from plastics material without any remachining.

6. Connector according to claim 3, wherein said retaining, blocking, releasing, snap-fastening and unblocking, and locking means are integrally moulded with said housings and said locking ring from plastics material without any remachining.

7. Connector according to claim 1, wherein said retaining means comprise at least one tab protruding inwardly on said locking ring and co-operating by elasticity with an outer groove of the housing of said second connector part.

8. Connector according to claim 7, wherein said releasing means comprise at least one axially extending external key on the housing of said first connector part, for pushing said tab outwardly and releasing it from said groove during interfitting of said two housings.

9. Connector according to claim 7, wherein said releasing means comprise at least one stud movable radially on the housing of said second connector part between an inner position, in which it is brought by elasticity and projects radially inwards beyond said housing, and an outer position, in which it is brought by the housing of said first connector part and in which it pushes outwardly said tab on said locking ring.

10. Connector according to claim 1, wherein said snap-fastening and unblocking means comprise at least one stud movable radially on the housing of said second connector part between a position, in which said stud projects radially outwards by an elasticity effect, and a position, in which it projects radially inwards counter to the elasticity effect, an inner groove provided in the locking ring, for receiving said stud when the latter is pushed outwardly by the housing of said first connector part, at the beginning of said interfitting movement, and an outer groove in the housing of said first connector part, for receiving said stud by snap-fastening at the end of said interfitting movement.

11. Connector according to claim 9, wherein said stud is formed at the free end of an elastic lug protruding on the housing of said second connector part.

12. Connector according to claim 9, wherein said stud is formed on an elastic collar retained in an outer groove of the housing of said second connector part.

13. Connector according to claim 10, wherein the said stud is formed on an elastic collar retained in an outer groove of the housing of said second connector part.

* * * * *